United States Patent [19]

Medrano

[11] 4,336,661

[45] Jun. 29, 1982

[54] SHOE INSERT

[76] Inventor: Walter A. Medrano, 13420 SW. 51 St., Miami, Fla. 33175

[21] Appl. No.: 142,260

[22] Filed: Apr. 21, 1980

[51] Int. Cl.[3] ..... A43B 13/38; A43B 13/40; A43B 7/08

[52] U.S. Cl. ..... 36/44; 36/3 B; 428/90

[58] Field of Search ..... 36/44, 43, 3 B, 3 R; 428/90

[56] References Cited

U.S. PATENT DOCUMENTS

| | | | |
|---|---|---|---|
| 1,342,967 | 6/1920 | McMaster | 36/44 |
| 2,808,663 | 10/1957 | Frieder et al. | 36/44 |
| 3,005,271 | 10/1961 | Brahm | 36/3 B |
| 3,253,355 | 5/1966 | Menken | 36/3 R |
| 3,257,743 | 6/1966 | Closson, Jr. et al. | 428/90 X |
| 3,418,732 | 12/1968 | Marshack | 36/44 |
| 3,457,659 | 7/1969 | Coleman | 36/44 |
| 3,655,497 | 4/1972 | Forrest | 428/90 |
| 4,224,746 | 9/1980 | Kim | 36/3 B |

FOREIGN PATENT DOCUMENTS

| | | | |
|---|---|---|---|
| 1145630 | 5/1957 | France | 36/3 B |
| 246099 | 10/1960 | France | 36/3 R |
| 103618 | 1/1942 | Sweden | 36/44 |
| 406529 | 3/1934 | United Kingdom | 36/44 |

*Primary Examiner*—James Kee Chi

*Attorney, Agent, or Firm*—John Cyril Malloy

[57] ABSTRACT

A shoe insert in the form of an envelope which is air impervious and sized to fit within the shoe of a wearer and which is composed of an upper surface and a lower surface interconnected by a side surface and a pad arranged in spanning relation within the envelope, the pad being of cushioning material and preferably having a plurality of holes arranged in a pattern extending through the pad but not through the envelope. In one preferred embodiment the envelope is closed and some air withdrawn from the envelope before it is closed to provide an air cushion. In a second preferred embodiment, the envelope has a hole through it to create an air pump and circulation effect in the shoe of a wearer.

2 Claims, 5 Drawing Figures

SHOE INSERT

FIELD OF THE INVENTION

This invention relates to an insert to be worn inside a shoe of a wearer.

OBJECTS OF THE INVENTION

It is an object of this invention to provide an improved insole or insert for shoes which utilizes increased air circulation for the comfort of the wearer and at the same time cushions and ventilates the feet of a wearer whether standing, walking or jogging and provides softness as well as comfort.

The instant invention uses a macro-porous vacuum action with bivalve air pressure release for a walking on air sensation. It also absorbs the shock of jogging, walking, and resists permanent matting down while one stands for long hours so long as there is slight movement.

It is a general object of this invention to provide an improved insert which releases air as one uses shoes in which they are inserted. As the weight is exerted air is released, and when the weight is withdrawn, the air is absorbed so that the entire process is accomplished readily and is most comfortable.

It is an object of this invention to provide air pump and circulating shoe inserts which are composed of an envelope of non-porous material, insofar as air is concerned, which is provided with a single hole through it, so that when walking, there is a pumping action of air in two stages, first, when the heel hits, and second, when the front zone of the foot hits so that there is cyclically or continually expelled and released and circulated within the shoe between the foot and the insert. The air flow is cooling, comfortable and ventilates the feet and, additionally, where a pad is provided within the envelope of foam material to serve as an excellent cushion to absorb shock.

In accordance with these and other objects which will become apparent hereinafter, the instant invention will now be described with reference to the accompanying drawings in which:

DESCRIPTION OF THE PREFERRED EMBODIMENT

Figure 1:
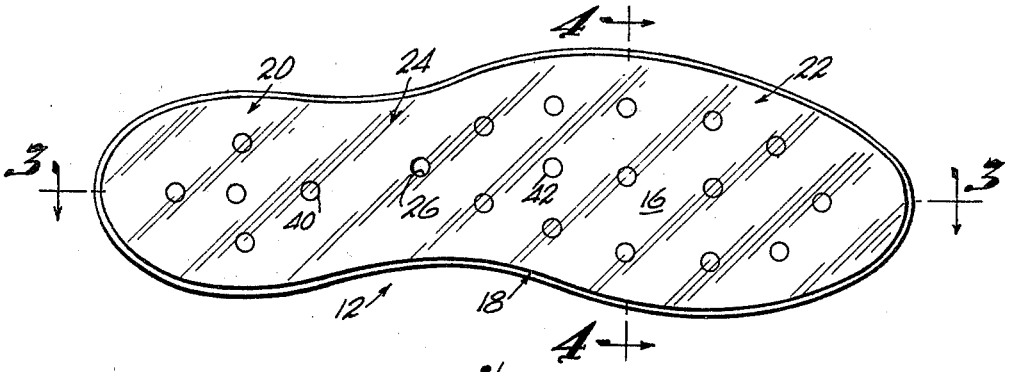
FIG. 1 is a bottom plan view of the insert of the instant invention.
Figure 2:
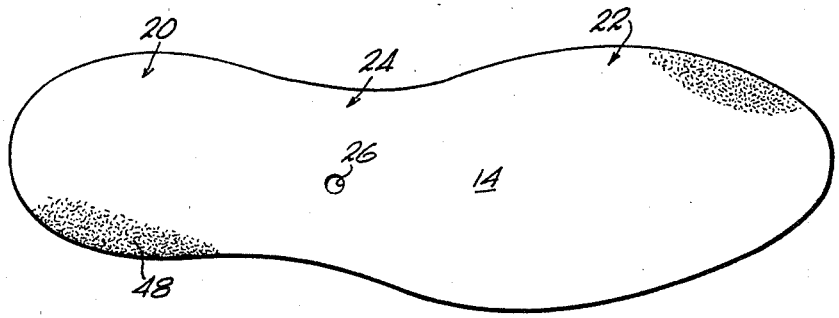
FIG. 2 is a top plan view of the insert of the instant invention.
Figure 3:
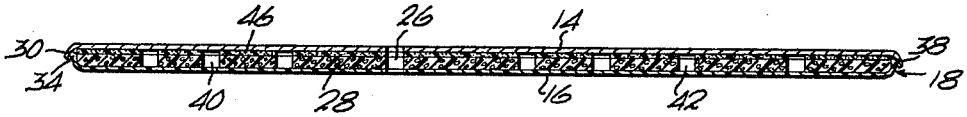
FIG. 3 is a view in cross section taken along the centerline 3—3 generally of the insert.
Figure 4:
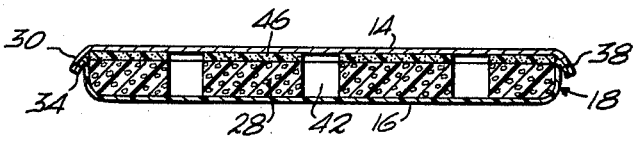
FIG. 4 is an enlarged view taken on the plane indicated by the line 4—4.

Referring to the drawings wherein like reference characters designate like or corresponding parts throughout the several views and referring particularly to FIG. 1, there is shown an insert which is composed of an envelope 12 of material which is impervious to air, such as a sheet of flexible pliable plastic. The envelope as seen in plan traces the outline of a human foot; and it has an upper surface 14 and a lower surface 16 and a side surface 18.

For convenience in further reference, the outline may be considered as having a heel zone 20, a forward zone 22 and an intermediate zone 24. It is seen that there is a hole 26 through the intermediate zone of about ¼" diameter spaced from the side edges an preferably along a longitudinal centerline of the insert generally. Within the envelope, a pad 28 of cushioning material is provided. This pad 28 is sized to nestle between the upper and lower surfaces generally spanning the interior of the envelope. The sidewall 18 is composed of the downwardly turned peripheral zone 30 of the upper surface of the envelope which does not extend straight downwardly but, rather, outwardly and downwardly; and the sidewall is further composed of an upwardly extending peripheral zone of the lower surface of the envelope which extends outwardly and upwardly terminating in an enshrouded edge 34 which is heat-sealed as indicated by the numeral 38 to the upper surface. The pad within the envelope is composed of a yieldable foam material and preferably has a plurality of holes such as 40 and 42 arranged in a pattern and extending through the pad, but not the envelope. In the preferred embodiment, between the pad and the upper surface, a layer 46, of about 1/16 to ⅛" thickness of rubbery material is provided, which is adhesively secured to the foam and to the inside surface of the upper surface panel of the envelope. The pad is preferably impregnated with very fine charcoal. The upper surface of the envelope is preferably of flocked material see at 48 to provide a smooth cloth-like feel texture and friction quality. The upper and lower surfaces are heat-sealed together; the lower surface may be of polyethylene plastic sheet material.

In use, when the inserts are within a shoe, one who is wearing them will place his heel down and when walking which will force air through the foam material and within the envelope into the front portion releasing some through the central hole in the intermediate portion and, as the rolling action of the walking movement of the foot takes place, there will be pressure applied to the front portion of the envelope which will again cause a release of air in the intermediate zone with the result that one walking with shoes with the insert will find that there is an increased circulation of air within the shoe making them much more comfortable and providing a much softer and more enjoyable walk.

Figure 5:
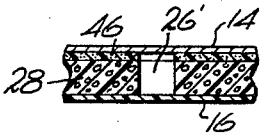
FIG. 5 is a partial view in cross section similar to that of FIG. 4, but, generally, showing a somewhat modified embodiment.

The envelope may be of vinyl plastic, which may be flocked or transparent. Preferably the top surface layer is about gauge 8; the bottom is about gauge 10. The overall height is preferably 3/16 of an inch and not over ½ of an inch or less than 1/16 of an inch. It will be seen that the downwardly turned flange comprises a shield and does not cause soreness, that is, the feet of the wearer to become sore. With respect to the embodiment shown in FIG. 5, it is seen that, in contrast to the hole 26, in the embodiments shown in FIGS. 1 through 4, in which embodiment the hole is completely through the device, the envelope at the hole 26' is closed at the top 14' as well as at the bottom 16. In this embodiment the insert is slightly evacuated; however, it operates in substantially a similar fashion and does not provide the pumping action for circulation but still provides the highly favorable beneficial results of the device.

While the instant invention has been shown and described herein in what is conceived to be the most practical and preferred embodiment, it is recognized that departures may be made therefrom within the scope of the invention, which is therefore not to be limited to the details disclosed herein but is to be accorded the full scope of the claims so as to embrace any and all equivalent apparatus and articles.

What is claimed is:

1. A shoe insert comprising:

an envelope of air impervious material, said envelope, as seen in plan, tracing the outline of a human foot;

said envelope having an upper surface and a lower surface and a side surface joining said upper and lower surfaces, said outline having a heel zone, a forward zone and an intermediate zone, a flat pad of cushioning foam material in the envelope nestled betweeen the upper and lower and side surfaces;

said side surface comprising a portion extending downwardly and outwardly from said top surface toward but not to said bottom surface and said side surface further comprises a portion extending upwardly from said bottom surface toward but not to said upper surface, and said downwardly extending portion having an inside surface and said portion extending upwardly having an outside surface and said upwardly and downwardly extending portions being heat-sealed at the inside surface of the downwardly extending portion and the outside surface of the upwardly extending portion to enshroud the upwardly extending portion a hole being provided through the upper surface in said intermediate zone spaced from said side surface.

2. The device as set forth in claim 1 wherein a hole is provided in said lower surface in said intermediate zone.

* * * * *